US010165657B2

(12) United States Patent
Kelly

(10) Patent No.: US 10,165,657 B2
(45) Date of Patent: Dec. 25, 2018

(54) DRIVER CIRCUIT FOR A LIGHT SOURCE AND METHOD OF TRANSMITTING DATA OVER A POWER LINE

(71) Applicant: Tridonic GmbH & Co KG, Dornbirn (AT)

(72) Inventor: Jamie Kelly, North Shields (GB)

(73) Assignee: Tridonic GmbH & Co KG, Dornbirn (AT)

( * ) Notice: Subject to any disclaimer, the term of this patent is extended or adjusted under 35 U.S.C. 154(b) by 29 days.

(21) Appl. No.: 14/915,693

(22) PCT Filed: Sep. 4, 2014

(86) PCT No.: PCT/AT2014/050195
§ 371 (c)(1),
(2) Date: Mar. 1, 2016

(87) PCT Pub. No.: WO2015/031929
PCT Pub. Date: Mar. 12, 2015

(65) Prior Publication Data

US 2016/0198551 A1 Jul. 7, 2016

(30) Foreign Application Priority Data

Sep. 6, 2013 (EP) ..... 13183310

(51) Int. Cl.
*H05B 37/02* (2006.01)
*H05B 33/08* (2006.01)

(52) U.S. Cl.
CPC ..... *H05B 37/0263* (2013.01); *H05B 33/0806* (2013.01); *H05B 33/0842* (2013.01)

(58) Field of Classification Search
CPC ..... H05B 37/0263; H05B 37/0254; H05B 37/034; H05B 33/0815
See application file for complete search history.

(56) References Cited

U.S. PATENT DOCUMENTS 5,471,119 A 11/1995 Ranganath et al.
5,668,446 A * 9/1997 Baker ..... H05B 37/02 315/158

(Continued)

FOREIGN PATENT DOCUMENTS

CN 101614358 A 12/2009
CN 102006701 A 4/2011
JP 2008077882 A 4/2008

OTHER PUBLICATIONS

Chinese Search Report issued in connection with the corresponding Chinese Patent Application No. 201480046830.6.

(Continued)

*Primary Examiner* — Tung X Le
*Assistant Examiner* — Borna Alaeddini
(74) *Attorney, Agent, or Firm* — The H.T. Than Law Group

(57) ABSTRACT

A driver circuit (21) for a light source (20) comprises an input configured for coupling to a power line (19). A control device (24) is configured to control at least one controllable switch (23) to control an output current or output voltage of the driver circuit (21). The control device (24) is configured to modulate a signal onto the power line (19) by setting a switching frequency of the at least one controllable switch (23) in dependence on data to be transmitted by the driver circuit (21; 121, 131) over the power line (19).

10 Claims, 6 Drawing Sheets

(56) References Cited

U.S. PATENT DOCUMENTS

| | | | | |
|---|---|---|---|---|
| 6,198,230 | B1 | 3/2001 | Leeb et al. | |
| 8,405,488 | B1 * | 3/2013 | Jacobs | H05B 37/0263 315/224 |
| 8,699,887 | B1 * | 4/2014 | Rothenberg | H04B 10/116 315/158 |
| 8,890,663 | B2 * | 11/2014 | Covaro | H03K 7/08 340/12.16 |
| 9,369,178 | B2 * | 6/2016 | Matsutani | H04B 3/548 |
| 2006/0056855 | A1 * | 3/2006 | Nakagawa | G09F 9/33 398/183 |
| 2012/0280638 | A1 * | 11/2012 | Pereira | H05B 33/0842 315/297 |
| 2014/0270794 | A1 * | 9/2014 | Rothenberg | H04B 10/116 398/118 |

OTHER PUBLICATIONS

Machine translation of CN 101614358 to Gao.
Machine translation of CN 102006701 to Liang.
Machine translation of JP 2008077882 to Juichi.
International Search Report and Written Opinion issued in connection with the corresponding International Application No. PCT/AT2014/050195 dated Feb. 2, 2015.

* cited by examiner

DRIVER CIRCUIT FOR A LIGHT SOURCE AND METHOD OF TRANSMITTING DATA OVER A POWER LINE

TECHNICAL FIELD

The invention relates to driver circuits for lights sources and to methods of communicating over a power line. The invention relates in particular to driver circuits for light sources which are operative to transmit data using power line communication (PLC).

BACKGROUND

Novel light sources such as light sources based on light emitting diodes (LEDs) or discharge lamps become increasingly more popular. Driver circuits for such light sources are operative to provide an output current or output voltage to a light-emitting means of the light source. The driver circuits may also be configured to perform additional functions, including control and/or communication functions. For illustration rather than limitation, communication between a driver circuit for a light source and a master unit may facilitate the implementation of automatic monitor procedures in which the correct operation of the light source is monitored by the master unit, automatic control of the light source by the master unit, and/or the implementation of feedback control loops in a lighting system having one or several light sources and which require the light source(s) to report data to the master unit.

Power line communication (PLC) is attractive because no separate, dedicated communication lines connected to the light source are required. PLC may be implemented in various forms. In some forms, PLC may be implemented as a one way communication. Supply interruptions and/or reversal of a direct current (DC) supply may be used to transmit data from a master to a slave. These techniques have the advantage of being inexpensive. However, the techniques may cause major disruption to the supply and may have severe limitations when it comes to individually addressing one of plural slaves connected to a same power line.

In other forms of PLC, a modulated signal is applied to a supply. Such techniques may also implement a two-way communication in which a slave can reply, sending communication back to the master. Conventionally, a dedicated PLC modulator is provided in the slave for modulating a signal onto the power line for communication towards the master. It is a considerable challenge to implement the PLC modulator of the slave in a cost-efficient manner. Power consumption caused by the PLC modulator may also be a concern. For illustration, a chipset which provides a receiver and transmitter may be used in the slave. The power dissipation of the transmitter and the power supply for the transmitter raise issues which must be addressed, e.g. by using dedicated componentry for supplying power to an amplifier of the transmitter and/or by providing dedicated heat sinks. This may add to the costs of the system, which is unattractive for many applications.

SUMMARY

There is a continued need in the art for devices, systems and methods in which power line communication (PLC) can be implemented in a cost-efficient way. There is in particular a need for devices, systems and methods which allow a slave unit to transmit data to a master unit via a power line, while mitigating the problems associated with the power consumption and costs of conventional techniques.

According to embodiments, communication over a power line from a driver circuit towards another device is implemented by controlling a switching frequency of at least one controllable switch of the driver circuit. A switching circuit of the driver circuit is thereby used as a source of signals modulated on a DC supply on the power line. It is not required to provide a dedicated PLC modulator in the driver circuit for this purpose. The at least one controllable switch may be a power switch of a converter, for example.

According to embodiments, a driver circuit and method as defined by the independent claims are provided. The dependent claims define features of further embodiments.

A driver circuit according to an embodiment comprises an input configured for coupling to a power line. The driver circuit comprises a switching circuit coupled to the input and which comprises at least one controllable switch. The driver circuit comprises a control device configured to control the at least one controllable switch to control an output current or output voltage of the driver circuit. The control device is configured to set a switching frequency of the at least one controllable switch in dependence on data to be transmitted by the driver circuit over the power line.

The control device may be configured to modulate a signal onto the power line by setting a switching frequency of the at least one controllable switch in dependence on data to be transmitted by the driver circuit over the power line.

The driver circuit controls a switching frequency of the at least one controllable switch to transmit data. This modulates a signal onto the supply on the power line. The signal may be received and processed by a master unit. No dedicated PLC modulator separate from the at least one controllable switch and its control device must be provided in the driver circuit to transmit data from the driver circuit to the master unit.

The control device may be configured to control the output current of the driver circuit by setting the switching frequency to at least one frequency which is a function of both a target output current of the driver circuit and the data to be transmitted.

The control device may be configured to control the output current of the driver circuit by sequentially setting the switching frequency to plural frequencies, the plural frequencies being a function of both the target output current of the driver circuit and the data to be transmitted.

The plural frequencies may comprise a first frequency and a second frequency which are harmonically interrelated. The first frequency and the second frequency may have a greatest common divisor which is greater than a predetermined threshold.

One of the first frequency and the second frequency may be an integer multiple of the other one of the first frequency and the second frequency.

The control device may be configured such that, for transmitting a data bit having a first logical value, the plural frequencies are included in a first group of frequencies.

The control device may be configured such that, for transmitting a data bit having a second logical value, the plural frequencies are included in a second group of frequencies.

The first group and the second group of frequencies may be different from one another. The first group and the second group of frequencies may be disjoint.

The control device may be configured such that, when no data are to be transmitted, the plural frequencies are included in a third group of frequencies. The third group may be different from the first group and the second group. The third group may be disjoint from the first group of frequencies and the second group of frequencies.

The control device may be configured to control the output current or output voltage of the driver circuit by alternating the switching frequency between the plural frequencies. The switching frequency may be alternated while one data bit is transmitted.

The control device may be configured to select the plural frequencies between which the switching frequencies is alternated depending on whether no data, a data bit having a first logical value or a data bit having a second logical value is to be transmitted.

The control device may be configured to adjust a timing with which the switching frequency is alternated between the plural frequencies in dependence on a target output current or target output voltage of the driver circuit. The control device may be configured to adjust a ratio of a first time interval in which the at least one controllable switch is switched with a first switching frequency and a second time interval in which the at least one controllable switch is switched with a second switching frequency in dependence on the target output current or the target output voltage.

The control device may be configured to perform a feedback control of the output current or output voltage of the driver circuit. The control device may be configured to adjust a timing with which the switching frequency is alternated in dependence on a comparison of an output current to the target output current.

The control device may be configured to detect a voltage ripple having a pre-defined frequency on the power line to receive other data over the power line from a master unit. Communication from the master unit towards the driver circuit over the power line may be implemented in this way.

The at least one controllable switch may comprise a first switch and a second switch. The first switch and the second switch may be a first switch and a second switch of a half-bridge converter.

The driver circuit may be configured as a DC/DC-converter.

The driver circuit may be configured as a constant current source.

According to another embodiment, a light source is provided. The light source comprises the driver circuit according to an embodiment and a light-emitting means connected to an output of the driver circuit.

The light emitting means may comprise at least one light emitting diode (LED). The at least one LED may comprise an inorganic LED and/or an organic LED.

According to another embodiment, a system is provided which comprises the driver circuit according to any embodiment and a master unit configured to supply power to the driver circuit via a power line. The master unit may comprise a power line demodulator coupled to the power line and may be configured to detect the data transmitted from the driver circuit over the power line.

A light emitting means may be connected to an output of the driver circuit.

The power line demodulator may be configured to detect a data bit having a first logical value if a frequency of a voltage ripple on the power line is any one of plural frequencies included in a first group of frequencies.

The power line demodulator may be configured to detect a data bit having a second logical value if the frequency of the voltage ripple on the power line is any one of plural frequencies included in a second group of frequencies. The first group and the second group may be disjoint.

The master unit may be configured to identify the driver circuit transmitting the data based on the frequency of the voltage ripple.

The master unit may comprise a PLC modulator for transmitting other data to the driver circuit.

The system may comprise at least one further driver circuit connected to the power line. The master unit may be configured to individually address one of the driver circuit and the at least one further driver circuit by selecting a frequency of a further signal modulated onto a supply voltage on the power line in dependence on which one of the driver circuits is to be addressed.

According to another embodiment, a master unit for controlling at least one driver circuit for a light source is provided. The master unit may comprise a PLC demodulator configured to determine a frequency of a signal on a power line, to detect transmission of a data bit having a first logical value if the frequency is included in a first group of frequencies, and to detect transmission of a data bit having a second logical value if the frequency is included in a second group of frequencies different from the first group.

The PLC demodulator may be configured to detect that no data is transmitted if the frequency of the signal on the power line is not included in the first group and is not included in the second group.

According to another embodiment, a method of transmitting data over a power line is provided. The method is performed by a driver circuit for a light source. The driver circuit has a switching circuit which comprises at least one controllable switch. The at least one controllable switch is controlled to control an output current or output voltage of the driver circuit. The method comprises setting a switching frequency of the at least one controllable switch in dependence on the data to be transmitted over the power line.

Additional features of the method which may be implemented in embodiments and the effects attained thereby correspond to the features and effects of the devices of embodiments.

The switching frequency may be alternated between plural frequencies. The plural frequencies may be selected depending on whether a data bit having a first logical value is to be transmitted, whether a data bit having a second logical value is to be transmitted, or whether no data is to be transmitted.

A timing with which the switching frequency is alternated may be adjusted depending on a target output current or target output voltage of the driver circuit.

The method may be performed by the driver circuit according to any embodiment.

In any one of the various embodiments, the at least one controllable switch may respectively comprise a controllable power switch. The at least one controllable switch may comprise a semiconductor switch having an isolated gate electrode.

The at least one controllable switch may comprise a field effect transistor (FET). The at least one controllable switch may comprise a metal oxide semiconductor field effect transistor (MOSFET).

In any one of the various embodiments, the switching frequency of a controllable switch may be defined as the inverse of a time interval between two successive switch-on operations or between two successive switch-off operations of the controllable switch.

In devices, methods and systems according to embodiments, the switching circuit of the driver circuit is used as a source of a signal modulated onto the bus voltage on the power line to transmit data. This allows communication from the driver circuit to a master unit to be implemented in a cost-efficient manner.

By alternating the switching frequency between plural different frequencies, the transmission of data may be readily combined with a control of the output current or output voltage of the driver circuit. The risk of incorrect demodulation at the master unit may be reduced and/or addressability of a driver circuit may be improved by defining groups of frequencies.

When plural frequencies are combined into one group depending on whether the plural frequencies are harmonically related, the risk of transmission errors may be reduced. When switching is performed at a first frequency, harmonics of the first frequency included in the same group of frequencies may still be associated with the correct logical value at the master unit.

BRIEF DESCRIPTION OF THE SEVERAL VIEWS OF THE DRAWINGS

Embodiments of the invention will be described in detail with reference to the drawings in which like reference numerals designate like elements.

DETAILED DESCRIPTION OF EMBODIMENTS

Exemplary embodiments of the invention will now be described in detail with reference to the drawings.

According to embodiments of the invention, a driver circuit is configured to transmit data over a power line. The driver circuit has at least one controllable switch. The at least one controllable switch is controlled to set an output current or output voltage of the driver circuit. The at least one controllable switch may control the charging or discharging of an inductance, for example. A switching frequency of the at least one controllable switch is controlled depending on the data to be transmitted to the master unit. For illustration, different frequencies may be used depending on whether no data is transmitted, a data bit corresponding to a logical "0" is to be transmitted, or a data bit corresponding to a logical "1" is to be transmitted.

Figure 1:
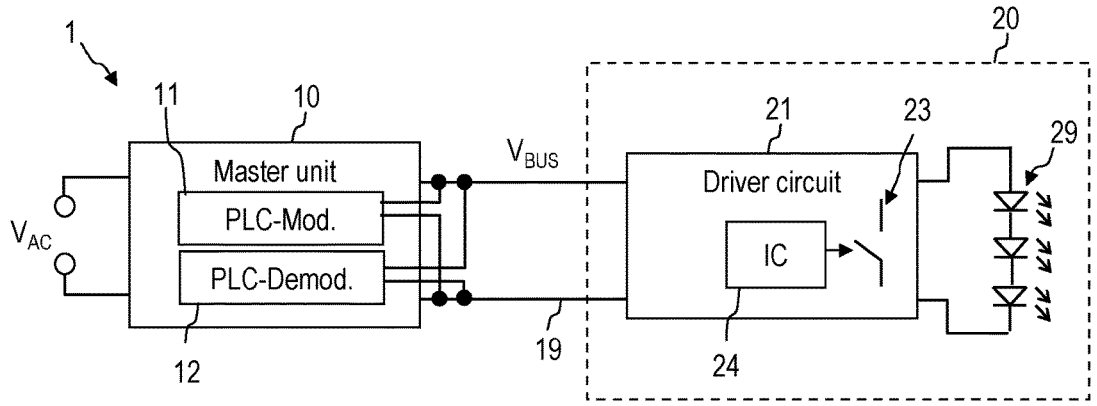
FIG. 1 is a diagram of a system having a driver circuit according to an embodiment.

FIG. 1 is a diagram of a system 1 according to an embodiment. The system 1 includes a master unit 10 and a light source 20. The master unit 10 may be configured as a central control unit remote from the light source 20. The master unit 10 may monitor the operation of one or several light sources. The master unit 10 may also issue commands to the one or several light sources, to control operation of the one or several light sources. The system 1 may be a lighting system of a building, for example.

The light source 20 has a driver circuit 21. An output current of the driver circuit 21 is fed to a light emitting means. The light emitting means may comprise one light emitting diode (LED) or plural LEDs 29. The one or plural LED(s) 29 may be inorganic and/or organic LEDs. The driver circuit 21 may operate as a current source for the LED(s) 29.

The master unit 10 may act as an AC/DC converter. The master unit 10 may receive an AC voltage at its input. The master unit 10 may perform AC/DC conversion and may provide a supply, also referred to as bus voltage, to an input of the driver circuit 21 of the light source 20.

The driver circuit 21 is connected to the master unit 10 via a power line 19. The power line 19 may comprise two wires.

The master unit 10 and the driver circuit 21 are configured to perform power line communication (PLC). The driver circuit 21 is configured to generate an AC signal superimposed on the supply on the power line 19 connected to the input of the driver circuit 21. The AC signal may be a voltage ripple generated by the driver circuit 21. The master unit 10 bas a PLC demodulator 12 to detect the AC signal generated by the driver circuit 21.

A switching circuit with a controllable switch 23 is used as a source for the AC signal by the driver circuit 21. The switching frequency of the controllable switch 23 is set to adjust an output current and/or output voltage of the driver circuit 21 to a desired value. In addition, the switching frequency of the controllable switch 23 is controlled in dependence on data which is to be transmitted. The controllable switch 23 may be a power switch of a DC/DC converter, for example. The controllable switch 23 may be connected between the input of the driver circuit 21 and an inductance. The controllable switch 23 may be a transistor. The controllable switch 23 may be a transistor having an isolated gate electrode.

The driver circuit 21 has a control device 24 to control the controllable switch 23. The control device 24 may be an integrated circuit. The control device 24 may be a microprocessor, processor, microcontroller, controller, or application specific integrated circuit (ASIC) which is operative to control the switching frequency of the controllable switch 23 in dependence on the data to be transmitted over the power line. The control device 24 may be configured to modulate a signal onto the power line 19 by setting a switching frequency of the controllable switch 23 in dependence on data to be transmitted by the driver circuit 21 over the power line 19.

To transmit a data bit having a first logical value (e.g. logical "0"), the control device 24 may control the controllable switch 23 such that it is switched with a pre-defined switching frequency.

To transmit a data bit having a second logical value (e.g. logical "0"), the control device 24 may control the controllable switch 23 such that it is switched with another predefined switching frequency. When no data is to be transmitted, the control device 24 may control the controllable switch 23 such that it is switched with yet another predefined switching frequency.

A frequency of a voltage ripple on the power line 19 depends on the respective switching frequency of the controllable switch 23. In this way, the driver circuit 21 may modulate an alternating signal component, for example a high-frequency signal, onto the supply voltage on the power line 19. The PLC demodulator 12 of the master unit 10 is operative to detect whether a data bit with a first or second logical value is transmitted over the power line, based on the frequency of the voltage ripple on the power line 19.

Communication from the master unit 10 to the driver circuit 21 may also be performed over the power line 19. A PLC modulator 11 of the master unit 10 may apply a modulated signal on the bus voltage on the power line 19 to transmit other data to the driver circuit 21. The PLC modulator 11 may modulate an AC voltage signal onto the bus voltage to transmit the other data to the driver circuit 21, with a frequency of the AC voltage signal depending on the other data. The driver circuit 21 may comprise a receiver coupled to the power line to detect the AC voltage signal generated by the master unit 10. The receiver or the control device 24 of the driver circuit 21 may process the other data received from the master unit 10. The master unit 10 may transmit a command to the driver circuit 21. The command may comprise a series of data bits. In response to receiving the command, the driver circuit 21 may transmit data to the master unit 10 by adjusting the switching frequency of the controllable switch 23 as a function of the data which is to be transmitted.

While only one driver circuit 21 coupled to the power line 19 is shown in FIG. 1, the system may comprise several driver circuits 21 coupled to the same power line 19. The master unit 10 and the various driver circuits may be operative to perform bidirectional PLC over the power line 19.

AC signals with different modulation frequencies may be applied by the master unit 10 to transmit data to different driver circuits. This allows the various driver circuits to be addressed individually by the master unit 10. Different driver circuits connected to the same power line 19 may be made to operate differently when the master unit 10 transmits commands which are addressed to one individual driver circuit. The master unit 10 may respectively select a modulation frequency of the AC signal which is uniquely assigned to one of the driver circuits to transmit the command to this driver circuit.

Additionally or alternatively, each one of the various driver circuits may be configured to switch its controllable switch 23 with switching frequencies different from the switching frequencies used by all other driver circuits connected to the power line 19. This allows the master unit 10 to uniquely identify the transmitting driver circuit when data is transmitted towards the master unit 10.

Additionally or alternatively, the master unit 10 may use two different frequencies to transmit data to different driver circuits. One of those two frequencies may be used to transmit a data bit corresponding to a logical "0" where the other frequency may be used to transmit a data bit corresponding to a logical "1" is to be transmitted. By selective transmission of such data bits an identifier can be transmitted and thus commands which are addressed to one individual driver circuit may be transmitted as each command may be transmitted with an identifier data at the beginning.

Thereby the system 1 can have one master 10 which uses two different frequencies to transmit data to different driver circuits 21 whereby the driver circuits 21 may transmit data back to master 10 by using additional frequencies.

The operation of the light source 20, and of any other light source connected to the power line 19, does not need to be interrupted for transmitting data. The driver circuit 21 may continue to feed current to the LED(s) 29 both when data are transmitted from the driver circuit 21 to the master unit 10 and when other data are transmitted from the master unit 10 to the driver circuit 21.

Figure 2:
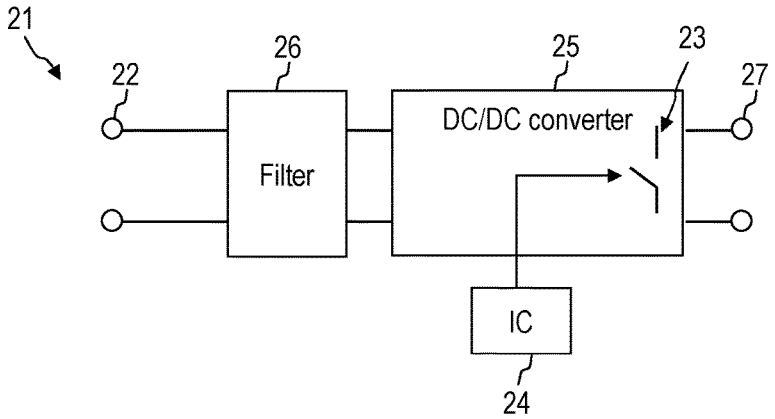
FIG. 2 is a block diagram of a driver circuit according to an embodiment.

FIG. 2 is a diagram showing the driver circuit 21 according to an embodiment. The driver circuit 21 has an input 22 for connecting the driver circuit 21 to the power line 19. The driver circuit 21 has an output 27 for feeding current to a light-emitting means. The light-emitting means may comprise a plurality of LEDs.

The driver circuit 21 may be configured to receive a DC supply at the input 22. The driver circuit 21 may include a DC/DC-converter 25 which comprises the controllable switch 23. The DC/DC-converter 25 may comprise several controllable switches, e.g. the switch 23 and a further switch (not shown) connected in series in a half-bridge configuration. An energy storage element, e.g. an inductance or a capacitance, may be coupled to the switch 23 and may be charged or discharged depending on whether the switch 23 is on or off.

The driver circuit 21 may optionally also include a filter 26 which attenuates an amplitude of the voltage ripple modulated onto the supply on the power line by switching the controllable switch 23. The filter 26 has low pass characteristics. The filter 26 may be a low pass filter, for example. The filter 26 may be selectively provided, depending on the power of the light source. For illustration, if plural light sources are all connected to the same power line 19, a filter 26 may be selectively provided in the driver circuit of only some of the light sources, in dependence on the power of the light source and associated driver circuit. The filter 26 may be selectively provided in a light source with a driver circuit having a power which is greater than a threshold, but not in a light source with a driver circuit having a power which is less than the threshold.

Figure 3:
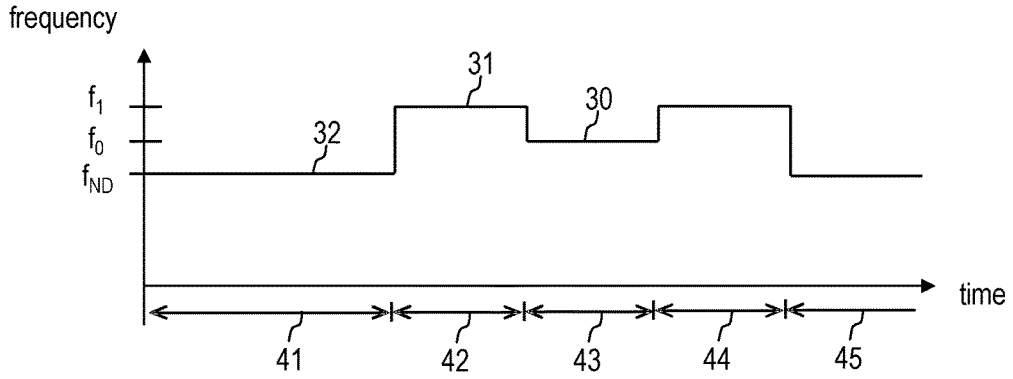
FIG. 3 illustrates a time-dependent control of a switching frequency to implement data transmission by a driver circuit according to an embodiment.

With reference to FIG. 3 to FIG. 13, operation of the driver circuit according to embodiments will be explained in more detail. Generally, the controllable switch 23 may be operated with different switching frequencies, depending on whether data are to be transmitted or not. In a time period in which data are transmitted, the switching frequency may be set in dependence on the data which are transmitted. Different switching frequencies may be used in dependence on whether a data bit having a first logical value (e.g. "0") or a data bit having a second logical value (e.g. "1") different from the first logical value is transmitted. FIG. 3 is a graph illustrating how the switching frequency of the controllable switch 23 is made to vary as a function of time in a driver circuit according to an embodiment.

During time periods 41, 45 no data are transmitted. The controllable switch 23 is operated such that the switching frequency has a value $f_{ND}$ assigned to the transmission of no data, as shown at 32.

During each one of time periods 42, 44, a data bit having a second logical value (e.g. "1") is respectively transmitted. The controllable switch 23 is operated such that the switching frequency has a value $f_1$ assigned to the transmission of a data bit having the second logical value, as shown at 31.

During a time period 43, a data bit having a first logical value (e.g. "0") is transmitted. The controllable switch 23 is operated such that the switching frequency has a value $f_0$ assigned to the transmission of a data bit having the first logical value, as shown at 30.

While a dedicated switching frequency 32 for is illustrated in FIG. 3 for no data transmission from the driver circuit to the master unit, the driver circuit does not need to provide such a dedicated switching frequency to signal that no data is to be transmitted. For illustration, in a time period without data transmission, the switching frequency could also be kept constant at one of the frequencies 30, 31 associated with a logical "0" or a logical "1". The start and end of a data transmission could be signalled by a pre-defined sequence of data bits.

The frequencies 30-32 may all be selected such that the output current provided by the driver circuit remains within a pre-defined tolerance from the target output current of the driver circuit. In other implementations, there may be plural frequencies which are each associated with the same data, e.g. a data bit which corresponds to a logical "0" or "1". The control device 24 may select the one of the plural frequencies associated with the data to be transmitted for which the output current of the driver circuit matches a target value.

Alternatively or additionally, the switching frequency may be made to alternate between the plural frequencies which are all associated with the same data or which are associated with the transmission of no data. In a time average, the output current of the driver circuit may thereby be set to a target output current.

For illustration, when no data is transmitted, the switching frequency of the controllable switch 23 may alternate between at least two frequencies. The PLC demodulator 12 of the master unit 10 may recognize any one of these at least two frequencies as being indicative for no data transmission. The control device 24 may control the times at which transitions between the at least two frequencies occur. The times may be set in dependence on a target output current of the driver circuit 21. When a feedback control is performed, the times at which the switching frequency makes a transition between the at least two frequencies may be set in dependence on a comparison of a time-averaged output current of the driver circuit to a target output current.

Alternatively or additionally, the switching frequency may be made to alternate between at least two other frequencies when data is to be transmitted. The switching frequency may be made to alternate between the at least two other frequencies while a data bit having a first logical value (e.g. "0") is transmitted. The PLC demodulator 12 of the master unit 10 may recognize any one of these at least two other frequencies as being indicative for a data bit having the first logical value. The control device 24 may control the times at which transitions between the at least two other frequencies occur while one data bit is being transmitted. The times may be set in dependence on a target output current of the driver circuit 21. When a feedback control is performed, the times at which the switching frequency makes a transition between the at least two other frequencies may be set in dependence on a comparison of a time-averaged output current of the driver circuit to a target output current.

Alternatively or additionally, the switching frequency may be made to alternate between at least two yet other frequencies when a data bit having a second logical value (e.g. "1") is transmitted.

The PLC demodulator 12 of the master unit 10 may recognize any one of these at least two yet other frequencies as being indicative for a data bit having the second logical value. The control device 24 may control the times at which transitions between the at least two yet other frequencies occur while one data bit is being transmitted. The times may be set in dependence on a target output current of the driver circuit 21. When a feedback control is performed, the times at which the switching frequency makes a transition between the at least two yet other frequencies may be set in dependence on a comparison of a time-averaged output current of the driver circuit to a target output current.

It is not required, but possible, for the switching frequency to alternate between different frequencies in each one of the various transmission states (no data transmission, data bit with value "0", and data bit with value "1").

In any state in which the switching frequency is made to alternate between at least two different frequencies, the at least two different frequencies may be harmonically related. For illustration, one of the switching frequencies may be an integer multiple of another one of the switching frequencies that is used in the same transmission state.

Figure 4:
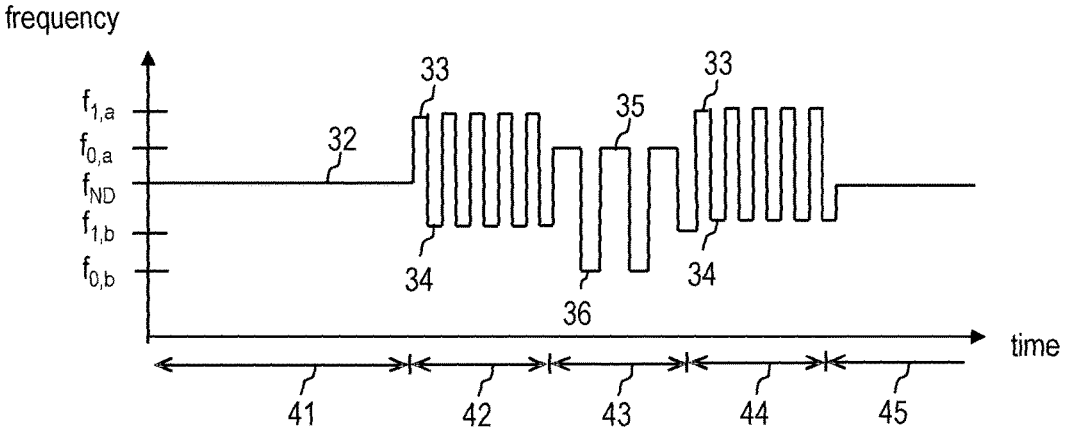
FIG. 4 illustrates a time-dependent control of a switching frequency to implement data transmission by a driver circuit according to an embodiment.

FIG. 4 is a graph illustrating how the switching frequency of the controllable switch 23 is made to vary as a function of time in a driver circuit according to an embodiment. In the implementation shown in FIG. 4, the switching frequency of the controllable switch is controlled such that it alternates between a first frequency and a second frequency while one data bit is being transmitted.

During each one of time periods 42, 44, a data bit having a second logical value (e.g. "1") is respectively transmitted. The controllable switch 23 is operated such that the switching frequency alternates between a first frequency 34 and a second frequency 33 during period 42 and during period 44, i.e., while one data bit is being transmitted. The first frequency 34 and the second frequency 33 are both assigned to the transmission of a data bit having the second logical value.

The PLC demodulator 12 of the master unit 10 identifies the first frequency 34 as being indicative for a transmission of a data bit having the second logical value from the driver circuit 21. In addition, the PLC demodulator 12 of the master unit 10 also identifies the second frequency 33 as being indicative for a transmission of a data bit having the second logical value from the driver circuit 21.

During the time period 43, a data bit having a first logical value (e.g. "0") is transmitted. The controllable switch 23 is operated such that the switching frequency alternates between another first frequency 36 and another second frequency 35 during period 43, i.e., while one data bit is being transmitted. The other first frequency 36 and the other second frequency 35 are both assigned to the transmission of a data bit having the first logical value. The PLC demodulator 12 of the master unit 10 identifies the other first frequency 36 as being indicative for a transmission of a data bit having the first logical value from the driver circuit 21. In addition, the PLC demodulator 12 of the master unit 10 also identifies the other second frequency 35 as being indicative for a transmission of a data bit having the second logical value from the driver circuit 21.

While not shown in FIG. 4, the switching frequency may optionally also alternate between at least two frequencies in the periods 41, 45 in which no data transmission is performed.

The output current of the driver circuit 21 respectively varies as a function of the switching frequency. When the switching frequency alternates between plural different frequencies, the output current also varies. The controllable switch 23 may be controlled such that, on a time average, the output current is set to a desired target output current value.

FIG. 5 to FIG. 8 illustrate an alternating behaviour of the switching frequency of the controllable switch 23 while the driver circuit 21 remains in the same transmission state. The behaviour explained with reference to FIG. 5 to FIG. 8 may be realized while no data is transmitted and/or while one data bit is respectively transmitted.

Figure 5:
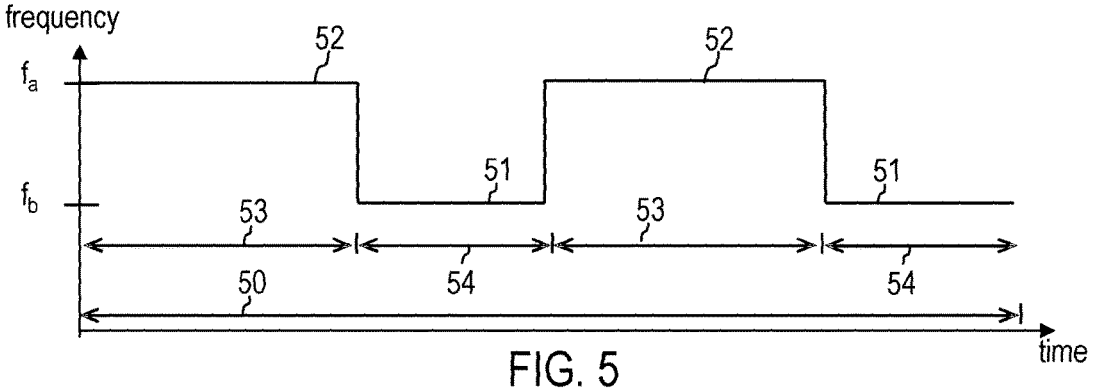
FIG. 5 illustrates a process of alternating a switching frequency by a driver circuit according to an embodiment.

FIG. 5 illustrates the switching frequency of the controllable switch as a function of time. The switching frequency is set to at least two different values during a time period 50 in which the driver circuit 21 remains in the same transmission state (e.g. no data transmission or transmission of one data bit).

In a time interval 54 during the period 50, the switching frequency is set to a first frequency 51. In another time interval 55 during the period 50, the switching frequency is set to a second frequency 52. The second frequency 52 and the first frequency 51 may be harmonically related. For illustration, the second frequency 52 may be an integer multiple of the first frequency 51. For further illustration, and as will be explained in more detail with reference to FIG. 7, the cycle times of switching cycles for switching with the first and second frequencies 51, 52 may have a greatest common divisor which is greater than one clock cycle of the control device 24.

A length of the time interval 54 in which the switching frequency is set to the first frequency 51 and/or a length of the time interval 55 in which the switching frequency is set to the second frequency 52 may be determined as a function of a target output current that is to be fed to the LED(s) connected to the output of the driver circuit 21.

Figure 6:
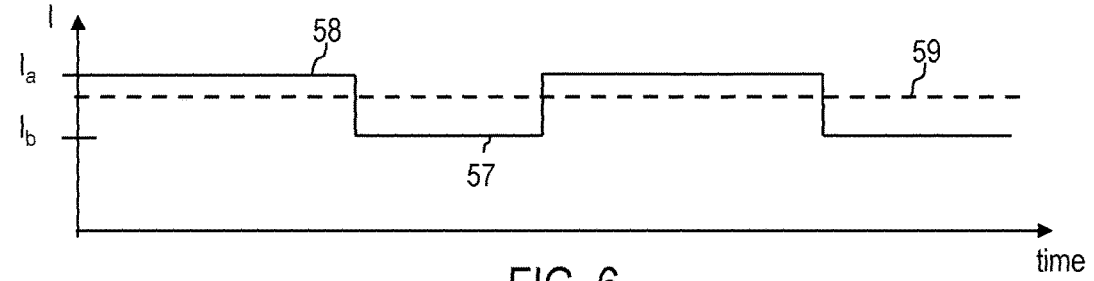
FIG. 6 illustrates an output current of the driver circuit resulting for the alternating switching frequency of FIG. 5.

FIG. 6 illustrates the output current of the driver circuit 21 during the time period 50. During this time period 50, the driver circuit 21 remains in the same transmission state (e.g. no data transmission or transmission of one data bit).

The change in switching frequency between the at least two frequencies 51, 52 causes a corresponding change in output current. When the controllable switch 23 is operated to have a switching frequency equal to the first frequency 51, the driver circuit 21 has a first output current 57. When the controllable switch 23 is operated to have a switching frequency equal to the second frequency 52, the driver circuit 21 has a second output current 58. On average, an output current 59 is obtained for the period 50 which corresponds to a desired target output current.

The output current 59 may be adjusted by adjusting the length of the time interval 54 in which the switching frequency is set to the first frequency 51 and/or a length of the time interval 55 in which the switching frequency is set to the second frequency 52.

Figure 7:
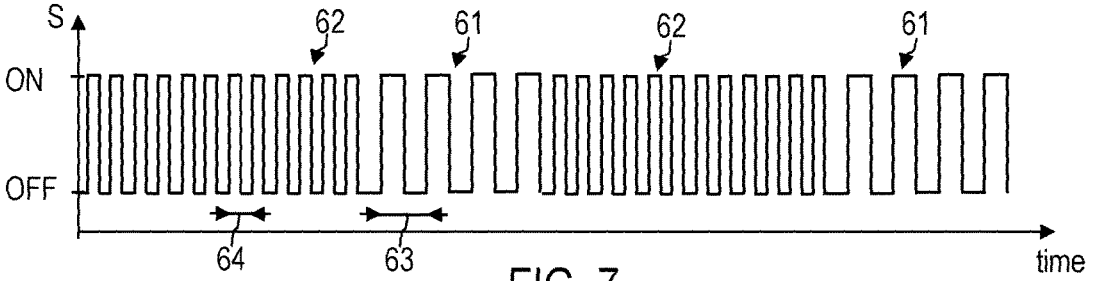
FIG. 7 illustrates a control signal for a controllable switch generated in the driver circuit according to an embodiment to implement the alternating switching frequency of FIG. 5.

FIG. 7 illustrates a control signal level generated by the control device 24 to control the controllable switch 23. During the time interval 53, the control signal 62 is generated such that the controllable switch 23 is switched on or is switched off with the second switching frequency 52. A cycle time 64 of the switching cycle for the second switching frequency 52 may be defined as the time interval between two successive raising edges or between two successive falling edges of the control signal 62. The second switching frequency 52 may be the inverse of the cycle time 64.

During the time interval 54, the control signal 61 is generated such that the controllable switch 23 is switched on or is switched off with the first switching frequency 51. A cycle time 63 of the switching cycle for the first switching frequency 51 may be defined as the time interval between two successive raising edges or between two successive falling edges of the control signal 61. The first switching frequency 51 may be the inverse of the cycle time 63.

For a control device 24 implemented as a digital processor or digital controller, different switching frequencies for the controllable switch 23 may be attained by incrementing or decrementing the number of clock cycles after which the controllable switch 23 is respectively switched on or off. When the switching frequency is alternated between plural different frequencies while the driver circuit remains in the same transmission state, the plural different frequencies which are associated with the same transmission state may be harmonically related to each other. For illustration, the cycle time 64 associated with the second switching frequency and the cycle time 63 associated with the first switching frequency may have a greatest common divisor which is greater than the clock cycle time of the control device 24. In the illustrated implementation, the cycle time 63 is twice the cycle time 64. The ratio of the cycle times 63, 64 may also be a rational number which is not an integer, e.g. 3/2 or 5/2.

If the switching circuit of the driver circuit comprises more than one controllable switch, control signals similar to the one shown in FIG. 7 may be generated for each one of the switches. The control signals for different switches may be phase-shifted relative to each other, e.g. to ensure that at most one of two switches connected in series is in its on-state at any given time.

Figure 8:
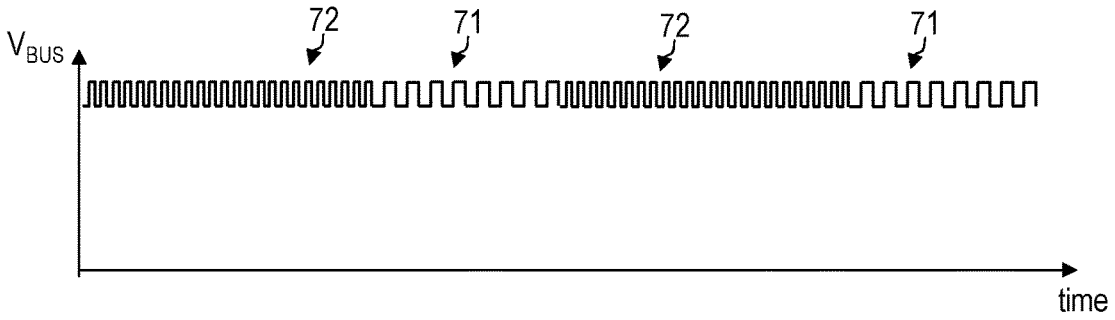
FIG. 8 illustrates a voltage ripple on a power line resulting for the alternating switching frequency of FIG. 5.

FIG. 8 illustrates the bus voltage on the power line 19 when the switching frequency of the controllable switch 23 is controlled to transmit data. The switching of the controllable switch 23 gives rise to an AC signal superimposed onto the DC supply on the power line. The frequency of the AC signal does not need to be identical to the switching frequency of the controllable switch 23, but is related thereto in a unique manner. For illustration, for two controllable switches in a series configuration, the voltage ripple on the power line 19 may have a frequency which is twice the switching frequency of each controllable switch.

FIG. 8 illustrates that switching the controllable switch with the first switching frequency 51 gives rise to a voltage ripple 71. Switching the controllable switch with the second switching frequency 52 gives rise to a voltage ripple 72. The frequency of the voltage ripple 71, 72 on the power line is related to the switching frequency 51, 52. For illustration, the voltage ripple on the power line may comprise an AC component having a frequency which is equal to, or an integer multiple of, the switching frequency.

For other transmission states, e.g. the transmission of a data bit having another logical value and/or a transmission state in which no data is transmitted from the driver circuit 21 to the master unit 10, other switching frequencies of the controllable switch 23 are used. Accordingly, the PLC demodulator 12 of the master unit 10 will identify the transmission state of the driver circuit based on the frequency spectrum of the voltage ripple on the power line.

Harmonics of the switching frequency may also be introduced. Such harmonics may result from the implementation of the driver circuit 21, for example. The amplitudes of the harmonics may depend on the specific configuration of the driver circuit 21.

By grouping the switching frequencies which are used for switching the controllable switch 23 in such a way that harmonically related frequencies are assigned to the same transmission state (e.g. no data transmission or transmission of a data bit with value "0" or transmission of a data bit with value "1"), the harmonic spectrum of the plural frequencies associated with the same transmission state are made to overlap at least partially. For illustration, the second harmonic of one of the frequencies may be the first harmonic of another one of the frequencies. Recognition of the transmission state by the PLC demodulator 12 of the master unit 10 can thereby be facilitated.

The control device 24 of the driver circuit 21 may implement a state control. The switching frequency of the controllable switch 23 may be set depending on the transmission state, e.g. depending on which data is to be transmitted or depending on whether no data is to be transmitted. At least one of the different transmission states may be associated with more than one switching frequency. The switching frequencies may be grouped depending on whether the harmonic spectra of the switching frequencies overlap, for example. The control device 24 may select one of the groups of frequencies depending on the transmission state. The control device 24 may select one or several of the frequencies included in the group for operating the controllable switch 23 to control an output current, for example.

Figure 9:
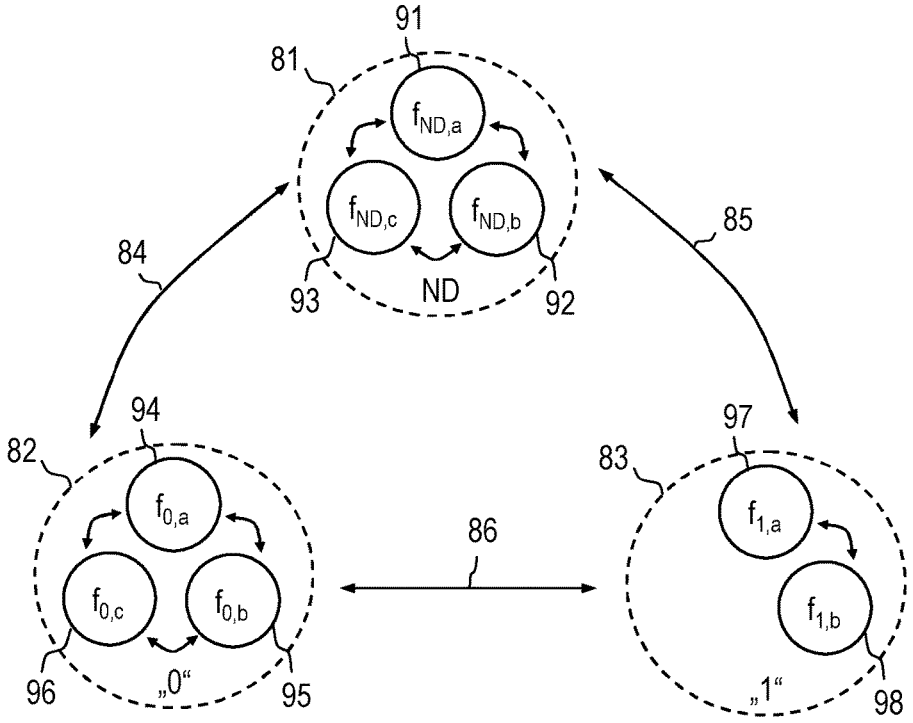
FIG. 9 illustrates a state control performed by the driver circuit according to an embodiment.

FIG. 9 illustrates the concept of state control which may be implemented in the driver circuit. A transmission state 81 corresponds to no data transmission. At least one other transmission state 82, 83 corresponds to data transmission. There may be two transmission states 82, 83 associated with the transmission of a data bit having a first logical value and a second logical value, respectively. More than two transmission states 82, 83 may be defined to encode numerical values in a switching frequency, for example.

Transitions 84-86 between the transmission states 81-83 may be made when a data transmission from the driver circuit 21 to the master unit 10 is started or terminated and/or to transmit a sequence of data bits.

A transition 84, 85 from the transmission state 81 to one of the transmission states 82, 83 which correspond to data transmission may be made when data transmission is started. The data transmission of the driver circuit 21 may be triggered by other data transmitted from the master unit 10 to the driver circuit 21 over the power line 19. Vice versa, a transition from one of the transmission states 82, 83 to the transmission state 81 which corresponds to no data transmission may be made when data transmission is terminated. A transition 86 between the transmission state 82 which corresponds to transmission of a data bit having a first logical value and the transmission state 83 which corresponds to transmission of a data bit having a second logical value may be made to transmit a sequence of data bits.

The transmission state 81 which corresponds to no data transmission is associated with at least one frequency 91-93 for switching the controllable switch. Plural frequencies 91-93 may be assigned to the transmission state 81. At least two of the plural frequencies 91-93 may be harmonically related. Each one of the plural frequencies 91-93 may be harmonically related to each other of the frequencies 91-93 that are assigned to the transmission state 81.

Similarly, the transmission state 82 which corresponds to data transmission is associated with at least one frequency 94-96 for switching the controllable switch. Plural frequencies 94-96 may be assigned to the transmission state 82. At least two of the plural frequencies 94-96 may be harmonically related. Each one of the plural frequencies 94-96 may be harmonically related to each other of the frequencies 94-96 that are assigned to the transmission state 82.

The switching frequencies which may be used in different transmission states may be selected such that a switching frequency of one transmission state is different from all switching frequencies which may be used in the other transmission states. For illustration, none of the plural frequencies 91-93 may be included in the groups of frequencies defined for the other transmission states 82, 83.

The switching frequencies which may be used in different transmission states may be selected such that a switching frequency of one transmission state not harmonically related to the switching frequencies of a different transmission state. A cycle time for switching the controllable switch with one of the switching frequency 91-93 (i.e., the inverse of the respective switching frequency 91-93) and another cycle time for switching the controllable switch with one of the switching frequency 94-96 (i.e., the inverse of the respective switching frequency 94-96) may have the clock cycle of the control device 24 as common greatest divisor.

The transmission state 83 may be associated with one or more than one frequency 97, 98. As illustrated in FIG. 9, different numbers of switching frequencies may be assigned to different transmission states.

If a transmission state is associated with more than one switching frequency, the selection of the switching frequency and, where appropriate, the timing at which the switching frequency is alternated may depend on a target output current of the driver circuit 21.

It is also possible that more than three groups of frequencies be defined. This allows more than three transmission states to be defined for one driver circuit. Alternatively or additionally, plural different driver circuits connected to the same power line may respectively be assigned at least two groups of frequencies to define at least two different transmission states. This allows plural driver circuits to communicate with one master unit 10 over the same power line 19.

Figure 10:
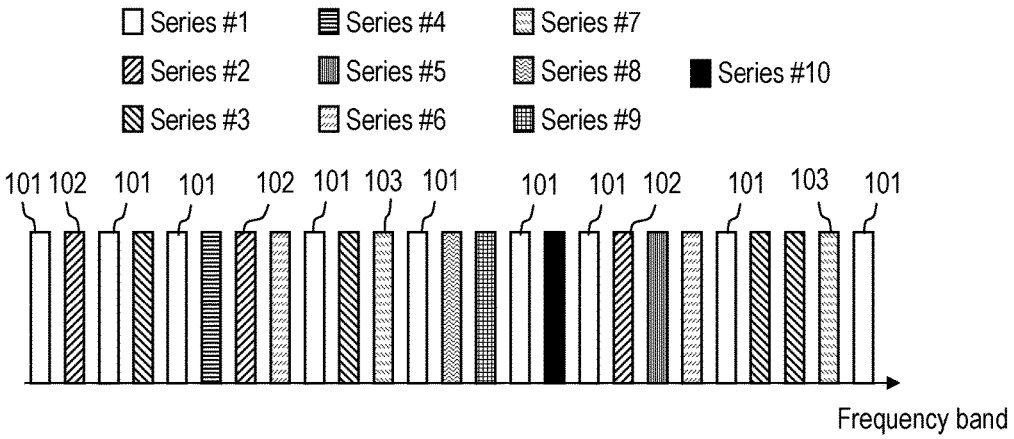
FIG. 10 illustrates the definition of groups of frequencies for communication between a master unit and one or several driver circuits according to an embodiment.

FIG. 10 schematically illustrates how frequencies are grouped into ten different series. Some of the series may include only one frequency. Other series may include more than one frequency. The grouping may be performed such that frequencies which are harmonically related are assigned to the same series.

A series of frequencies 101 may be assigned to a first driver circuit connected to the power line 19.

The controllable switch 23 of the first driver circuit may be operated with any one of the frequencies 101 in one of the transmission states, e.g. when no data is transmitted or when a data bit with a first logical value is transmitted. The PLC demodulator 12 of the master unit 10 may be configured such that it identifies the voltage ripple resulting from switching the switch 23 with any one of the frequencies 101 as the respective transmission state of the first driver circuit.

A series of other frequencies 102 may be assigned to a second driver circuit connected to the power line 19. A series of yet other frequencies 103 may be assigned to a third driver circuit connected to the power line. The PLC demodulator 12 of the master unit 10 may identify the driver circuit from which a data transmission originates and the respective data transmitted by the driver circuit based on the frequency spectrum of voltage ripples on the power line 19.

The switching frequencies which are assigned to one of the driver circuits may also be used by the master unit to transmit data to the respective driver circuit. For illustration, when the second driver circuit uses at least one of the frequencies 102 to transmit a data bit with a first logical value to the master unit 10, the PLC modulator 11 of the master unit may generate an AC modulation of the power supply with the same frequency to transmit data to the second driver circuit. The first driver circuit may be configured to detect that this modulated signal is not addressed to the first driver circuit. The third driver circuit may be configured to detect that the modulated signal is not addressed to the third driver circuit. The PLC modulator 11 of the master unit may use different modulation frequencies to individually address data to one of plural driver circuits connected to the power line 19.

Figure 11:
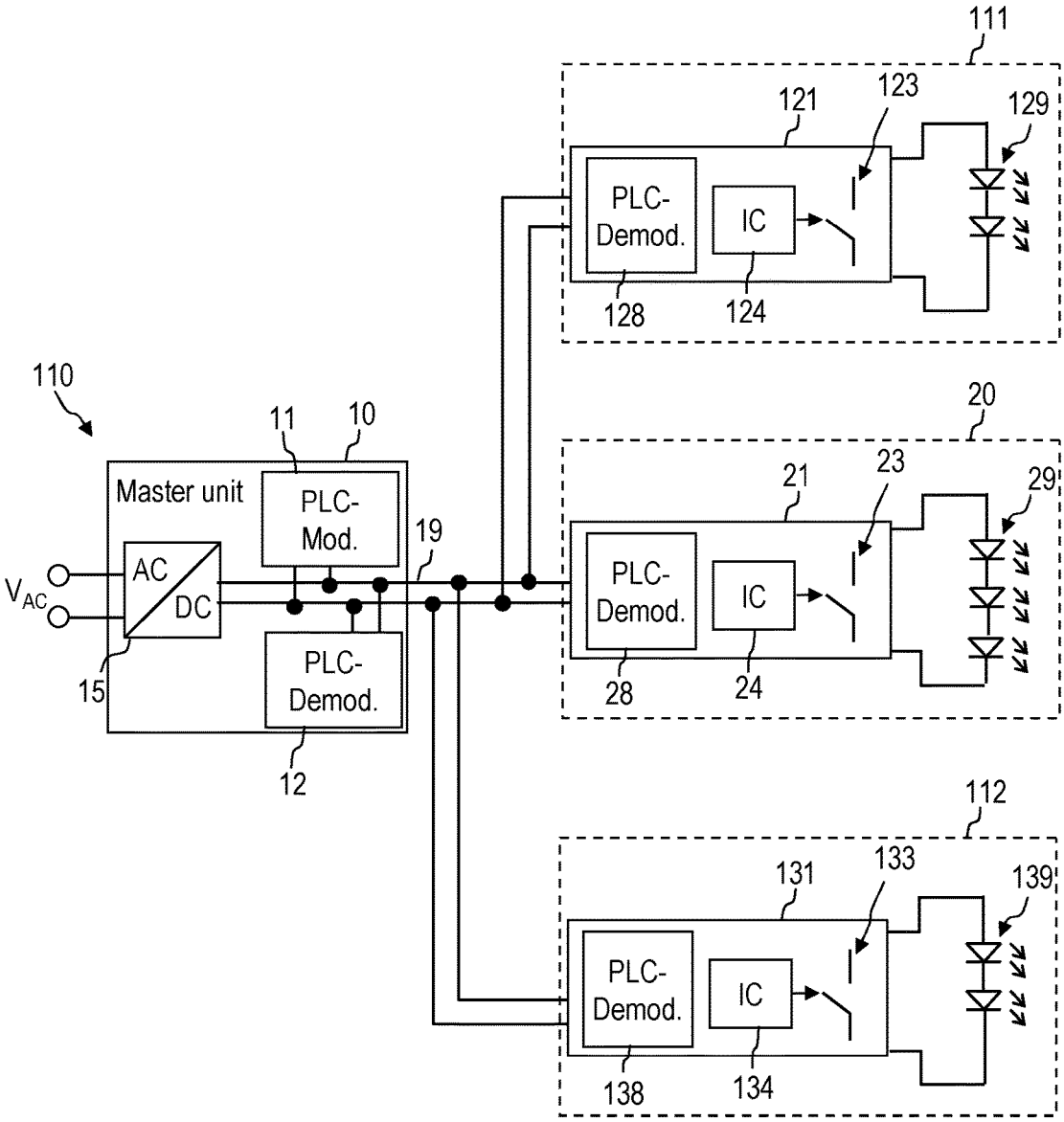
FIG. 11 is a diagram of a system according to another embodiment.

FIG. 11 shows a system 110 of an embodiment. The system includes a master unit 10. The master unit 10 may include an AC/DC converter 15. The master unit 10 may provide a DC supply to plural light sources 20, 111, 112 connected to a power line 19. The master unit 10 may have a PLC modulator 11 and a PLC demodulator operative as explained with reference to FIG. 1 to FIG. 10.

The light source 20 has a driver circuit 21. An output current of the driver circuit 21 depends on a switching frequency of a controllable switch 23. The switching frequency is set depending on data to be transmitted, as explained with reference to FIG. 1 to FIG. 10. The driver circuit 21 also has a PLC demodulator 28 configured to detect a modulated signal on the power line 19 which is addressed to the driver circuit 21. The PLC demodulator 28 may comprise a band pass filter or several band pass filters to identify an AC signal applied on the power line 19 which has a frequency reserved for communication between the master unit and the the driver circuit 21.

The light sources 111, 112 respectively also have a driver circuit 121, 131 to feed current to a light-emitting means 129, 139. The driver circuit 121, 131 has a controllable switch 123, 133. An output current of the driver circuit 121, 131 is fed to the light-emitting means 129, 139 and depends on a switching frequency of a controllable switch 123, 133. The controllable switch is used as a source of AC signals on the power line 19 to transmit data from the driver circuit 121, 131 to the master unit 10.

The driver circuits 21, 121, 131 connected to the same power line 19 may use different switching frequencies for their respective switch 23, 123, 133, as explained with reference to FIG. 10. The switching frequency or switching frequencies of the controllable switch 23 for data transmission from the driver circuit 21 to the master unit 10 may be different from the various switching frequencies at which the controllable switch 123, 133 of any other driver circuit 121, 131 connected to the power line 19 is operated. The switching frequency or switching frequencies of the controllable switch 23 of the driver circuit 21 when no data is transmitted may be different from the various switching frequencies at which the controllable switch 123, 133 of any other driver circuit 121, 131 connected to the power line 19 is operated.

If the driver circuits 21, 121, 131 are designed for different powers, at least one of the driver circuits 21, 121, 131 may comprise a filter. The filter may attenuate the amplitude of the voltage ripple generated by the controllable switch of the respective driver circuit on the power line 19.

As indicated in FIG. 11, the driver circuits 21, 121, 131 do not have a dedicated PLC modulator, but use the controllable switch 23, 123, 133 as source for AC signals modulated onto the DC supply on the power line 19. In other words, the switching circuit of the driver circuit, in combination with its control logic, functions as a PLC modulator. A driver circuit according to embodiments may also be configured such that it does not include a power factor correction (PFC) connected between the input and the controllable switch 23, 123, 133. A PFC may be provided by the master unit 10.

The techniques disclosed herein may be utilized with a wide variety of driver circuit configurations. For illustration, the driver circuit may include a resonance converter having a controllable switch. The driver circuit may include a resonance converter with two controllable switches in a half-bridge configuration. The two controllable switches of the half bridge may be switched on and off in an alternating manner. The two controllable switches may be connected to an energy storage means, e.g. an inductance or capacitance, which can be selectively charged or discharged depending on the state of the switches.

Figure 12:
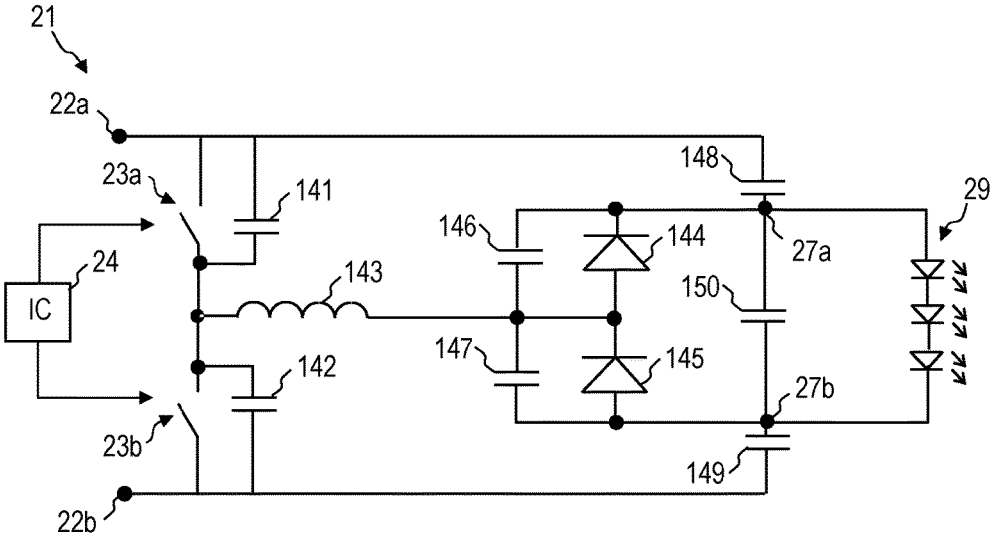
FIG. 12 is a circuit diagram of a driver circuit according to an embodiment.
Figure 13:
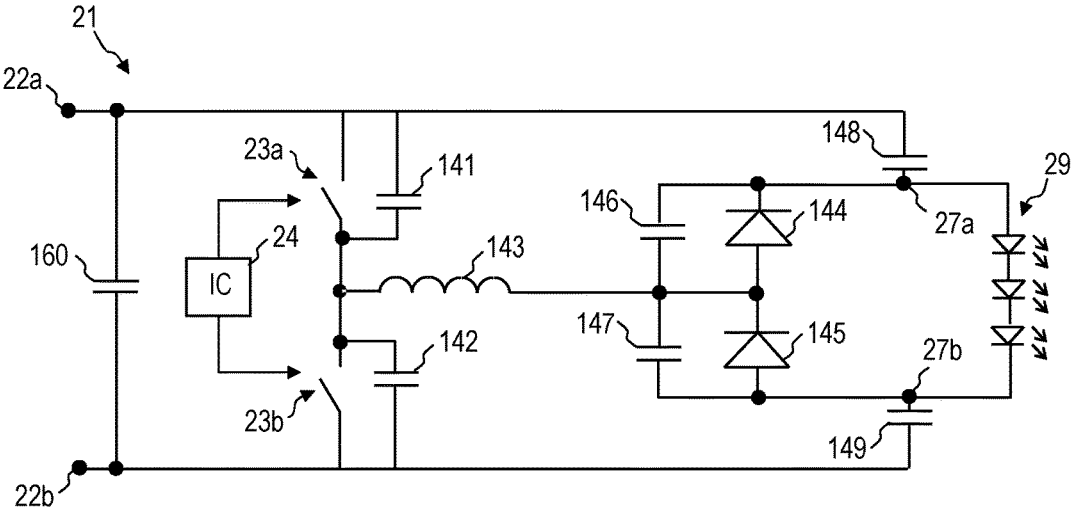
FIG. 13 is a circuit diagram of a driver circuit according to another embodiment.

FIG. 12 and FIG. 13 illustrate two exemplary converter topologies in which a controllable switch of a driver circuit is used as a source of an AC signal component on the power line.

FIG. 12 shows a driver circuit 21 according to an embodiment. The driver circuit includes a first controllable switch 23*a* and a second controllable switch 23*b* in a series configuration. A first capacitor 141 is connected in parallel with the first controllable switch 23*a*. A second capacitor 142 is connected in parallel with the second controllable switch 23*b*. The first and second controllable switches 23*a*, 23*b* are connected to input terminals 22*a*, 22*b* of the driver circuit 21.

The driver circuit 21 comprises a first diode 144 and a second diode 145 in a series connection. The cathode of the second diode 145 is connected to the anode of the first diode 144. A third capacitor 146 is connected in parallel to the first diode 144. A fourth capacitor 147 is connected in parallel to the second diode 145.

The driver circuit 21 comprises an inductance 143. A terminal of the inductance 143 is connected to a node in between the first and second controllable switches 23*a*, 23*b*. Another terminal of the inductance 143 is connected to the cathode of the second diode 145 and the anode of the first diode 144.

The cathode of the first diode 144 is connected to an output pin 27*a* of the driver circuit 21. The driver circuit 21 comprises a fifth capacitor 148 connected between the input terminal 22*a* and the output pin 27*a*.

The anode of the second diode 145 is connected to another output pin 27*b* of the driver circuit 21. The driver circuit 21 comprises a sixth capacitor 148 connected between another input terminal 22*b* and the other output pin 27*b*.

The driver circuit 21 comprises a capacitor 150 connected to both output pins 27*a*, 27*b*.

The driver circuit 21 comprises a control device 24 to control the first and second controllable switches 23*a*, 23*b*. The control device 24 may be configured as an integrated circuit. The control device 24 may control the first and second controllable switches 23*a*, 23*b* in such a way that at most one of the first and second controllable switches 23*a*, 23*b* is in its on-state at any time.

As explained above, the control device 24 is configured to set the switching frequency of the first controllable switch 23*a* and of the second controllable switch 23*b* in dependence on data to be transmitted. This produces a voltage ripple on the power line connected to the input terminals 22*a*, 22*b*. The voltage ripple is detected and decoded by a master unit.

FIG. 13 shows a driver circuit 21 according to another embodiment. The driver circuit 21 of FIG. 13 generally has a configuration and operation similar to the driver circuit 21 of FIG. 12. However, in the driver circuit 21 of FIG. 13, a capacitor 160 is connected between the input terminals 160. The capacitor 160 may act as a filter which attenuates an amplitude of the voltage ripples generated by the first and second controllable switches 23*a*, 23*b* on the power line.

The driver circuit and the master unit according to any one of the embodiments described herein may perform PLC using any suitable protocol. For illustration, the Digital Addressable Lighting Interface (DALI) protocol may be used. The driver circuit may be configured to transmit data over the power line, with the data being generated in accordance with the DALI protocol. The driver circuit may be configured to receive other data over the power line from the master unit, with the other data being generated in accordance with the DALI protocol. The data transmitted between the master unit and the driver circuit may include information relating to an operation state of the driver circuit, information on a dim level, information on a light color, or other information.

While embodiments have been described in detail with reference to the drawings, modifications may be implemented in other embodiments. For illustration rather than limitation, the switching frequency may be made to alternate between plural frequencies which are all associated with the same transmission state. Additionally or alternatively, operation of the controllable switch may be interrupted for short time periods after several switching cycles, to thereby control the time-averaged output current.

While embodiments have been described in which data may be transmitted as a series of data bits having one of two logical values, data may also be encoded in other ways. For illustration, the switching frequency may be set to a value which encodes an analogue, rather than digital, numerical value.

Embodiments of the invention may be used in lighting systems. Embodiments of the invention may in particular be used for driver circuits which feed current to LEDs, without being limited thereto.

The invention claimed is:

1. A driver circuit for a light source (20; 111, 112), comprising:

an input (22; 22*a*, 22*b*) configured for coupling to a power line (19);

a switching circuit (23*a*, 23*b*, 141-150; 23*a*, 23*b*, 141-149, 160) coupled to the input (22; 22*a*, 22*b*) and comprising at least one controllable switch (23; 123, 133; 23*a*, 23*b*); and a control device (24) configured to control the at least one controllable switch (23; 123, 133; 23*a*, 23*b*) to control an output current or output voltage of the driver circuit (21; 121, 131), the control device (24) being configured to modulate a signal onto the power line (19) by setting a switching frequency of the at least one controllable switch (23; 123, 133; 23*a*, 23*b*) in dependence on data to be transmitted by the driver circuit (21; 121, 131) over the power line (19)

wherein the control device (24) is configured to control the output current of the driver circuit (21; 121, 131) by setting the switching frequency to at least one frequency (30-32; 33-36; 51, 52; 91-93; 94-96; 97, 98) which is a function of both a target output current of the driver circuit (21; 121, 131) and the data to be transmitted wherein the control device (24) is configured to control the output current of the driver circuit (21; 121, 131) by sequentially setting the switching frequency to plural frequencies (33, 34; 35, 36; 51, 52; 91-93; 94-96; 97, 98), the plural frequencies (33, 34; 35, 36; 51, 52; 91-93; 94-96; 97, 98) being a function of both the target output current (59) of the driver circuit (21; 121, 131) and the data to be transmitted, and wherein the control device (24) is configured to control the output current of the driver circuit (21; 121, 131) by alternating the switching frequency between the plural frequencies (33, 34; 35, 36; 51, 52; 91-93; 94-96; 97, 98).

2. The driver circuit according to claim 1, wherein for transmitting a data bit having a first logical value, the plural frequencies are included in a first group of frequencies (35, 36; 94-96), and for transmitting a data bit having a second logical value, the plural frequencies are included in a second group of frequencies (33, 34; 97, 98), wherein the first group of frequencies (35, 36; 94-96) and the second group of frequencies (33, 34; 97, 98) are disjoint.

3. The driver circuit according to claim 1, wherein the plural frequencies are included in a third group of frequencies (91-93) when no data are to be transmitted.

4. The driver circuit according to claim 1, wherein the control device (24) is configured to detect a voltage ripple having a pre-defined frequency on the power line (19) to receive other data over the power line (19) from a master unit (10).

5. The driver circuit according to claim 1, wherein the at least one controllable switch comprises a first switch (23*a*) and a second switch (23*b*).

6. A light source (20; 111, 112), comprising:

the driver circuit according to claim 1, and at least one light emitting diode (29; 119, 129), LED, connected to an output (27; 27*a*, 27*b*) of the driver circuit (21; 121, 131).

7. A system, comprising a driver circuit for a light source (20; 111, 112), comprising:

an input (22; 22*a*, 22*b*) configured for coupling to a power line (19);

a switching circuit (23*a*, 23*b*, 141-150; 23*a*, 23*b*, 141-149, 160) coupled to the input (22; 22*a*, 22*b*) and comprising at least one controllable switch (23; 123, 133; 23*a*, 23*b*); and a control device (24) configured to control the at least one controllable switch (23; 123, 133; 23*a*, 23*b*) to control an output current or output voltage of the driver circuit (21; 121, 131), the control device (24) being configured to modulate a signal onto the power line (19) by setting a switching frequency of the at least one controllable switch (23; 123, 133; 23*a*, 23*b*) in dependence on data to be transmitted by the driver circuit (21; 121, 131) over the power line (19), and and a master unit (10) configured to supply power to the driver circuit (21; 121, 131) via a power line (19), wherein the master unit (10) comprises a power line demodulator (12) coupled to the power line (19) and configured to detect the data transmitted from the driver circuit (21; 121, 131) over the power line (19), wherein the power line demodulator (12) is configured to detect a data bit having a first logical value if a frequency of a voltage ripple (72) on the power line (19) is any one of plural frequencies included in a first group of frequencies.

8. The system according to claim 7, wherein the power line demodulator (12) is configured to detect a data bit having a second logical value if the frequency of the voltage ripple (71) on the power line (19) is any one of plural frequencies included in a second group of frequencies, the first group and the second group being disjoint.

9. The system according to claim 7, wherein the master unit (10) is configured to identify the driver circuit (21, 121, 131) transmitting the data based on the frequency of the voltage ripple (71, 72).

10. A method of transmitting data over a power line (19), the method being performed by a driver circuit for a light source (20; 111, 112), comprising:

an input (22; 22*a*, 22*b*) configured for coupling to a power line (19);

a switching circuit (23*a*, 23*b*, 141-150; 23*a*, 23*b*, 141-149, 160) coupled to the input (22; 22*a*, 22*b*) and comprising at least one controllable switch (23; 123, 133; 23*a*, 23*b*); and a control device (24) configured to control the at least one controllable switch (23; 123, 133; 23*a*, 23*b*) to control an output current or output voltage of the driver circuit (21; 121, 131), the control device (24) being configured to modulate a signal onto the power line (19) by setting a switching frequency of the at least one controllable switch (23; 123, 133; 23*a*, 23*b*) in dependence on data to be transmitted by the driver circuit (21; 121, 131) over the power line (19)

wherein the control device (24) is configured to control the output current of the driver circuit (21; 121, 131) by setting the switching frequency to at least one frequency (30-32; 33-36; 51, 52; 91-93; 94-96; 97, 98) which is a function of both a target output current of the driver circuit (21; 121, 131) and the data to be transmitted wherein the control device (24) is configured to control the output current of the driver circuit (21; 121, 131) by sequentially setting the switching frequency to plural frequencies (33, 34; 35, 36; 51, 52; 91-93; 94-96; 97, 98), the plural frequencies (33, 34; 35, 36; 51, 52; 91-93; 94-96; 97, 98) being a function of both the target output current (59) of the driver circuit (21; 121, 131) and the data to be transmitted, and wherein the control device (24) is configured to control the output current of the driver circuit (21; 121, 131) by alternating the switching frequency between the plural frequencies (33, 34; 35, 36; 51, 52; 91-93; 94-96; 97, 98), wherein the method comprises:

modulating a signal onto the power line (19) by setting a switching frequency of the at least one controllable switch (23; 123, 133; 23*a*, 23*b*) in dependence on the data to be transmitted over the power line (19).

* * * * *